United States Patent [19]

Petitti, Jr.

[11] 4,200,285

[45] Apr. 29, 1980

[54] RACQUET WEIGHT SYSTEM

[76] Inventor: Angelo Petitti, Jr., 2115 N. Sedgwick, Chicago, Ill. 60614

[21] Appl. No.: 858,363

[22] Filed: Dec. 7, 1977

[51] Int. Cl.[2] ..... A63B 69/38; A63B 49/04

[52] U.S. Cl. ..... 273/29 A; 273/73 R

[58] Field of Search ..... 273/73 R, 73 C, 73 F, 273/73 G, 73 H, 77 R, 81 R, 81 A, 81 D, 162 R, 171, 194 B, 165, 29 A

[56] References Cited

U.S. PATENT DOCUMENTS

| | | | |
|---|---|---|---|
| 2,608,409 | 8/1952 | Pinkerton | 273/194 B |
| 3,568,290 | 3/1971 | Carlton | 273/73 C |
| 3,582,072 | 6/1971 | Stueck | 273/73 C X |
| 3,740,053 | 6/1973 | Eiger | 273/194 B |
| 3,801,099 | 4/1974 | Lair | 273/73 C |
| 3,913,911 | 10/1975 | Peterson | 273/73 C |
| 4,005,864 | 2/1977 | Stewart | 273/73 R |
| 4,019,736 | 4/1977 | Lehew | 273/73 R |
| 4,042,238 | 8/1977 | Theriault | 273/73 D X |
| 4,052,061 | 10/1977 | Stewart | 273/73 R |
| 4,142,721 | 3/1979 | Faleck et al. | 273/73 R |

FOREIGN PATENT DOCUMENTS

| | | | |
|---|---|---|---|
| 848826 | 8/1970 | Canada | 273/73 F |
| 2554267 | 6/1977 | Fed. Rep. of Germany | 273/73 C |
| 211176 | 2/1924 | United Kingdom | 273/73 C |
| 252293 | 5/1926 | United Kingdom | 273/73 C |
| 253705 | 6/1926 | United Kingdom | 273/73 C |
| 310566 | 5/1929 | United Kingdom | 273/73 C |
| 751040 | 6/1956 | United Kingdom | 273/73 C |

*Primary Examiner*—Richard J. Apley

*Attorney, Agent, or Firm*—Jakala, Knechtel, Valentino, Demeur & Dallas

[57] ABSTRACT

There is disclosed an exercise and training attachment device for use in connection with the head of a sports racquet of the type formed by a substantially circular head rim adapted to accommodate a strung surface and having a handle portion extending outwardly therefrom, consisting of weight means formed by a pair of weighted resilient members, each of the weighted members having a substantially circular configuration along the exterior periphery thereof terminating in an interrupted neck portion formed by opposed legs, the weight members each including an interiorally cut-out mounting groove, the mounting groove corresponding with the external configuration of the circular head rim of the racquet, and the legs bounding the neck portion being sufficiently resilient to stretch laterally a distance sufficient to permit the weight member to be positionally mounted on the head rim. Each of the pair of weighted members is intended to be positioned in diametrically opposite positioning on the head rim so that a balanced racquet head is provided for exercise and training purposes.

8 Claims, 5 Drawing Figures

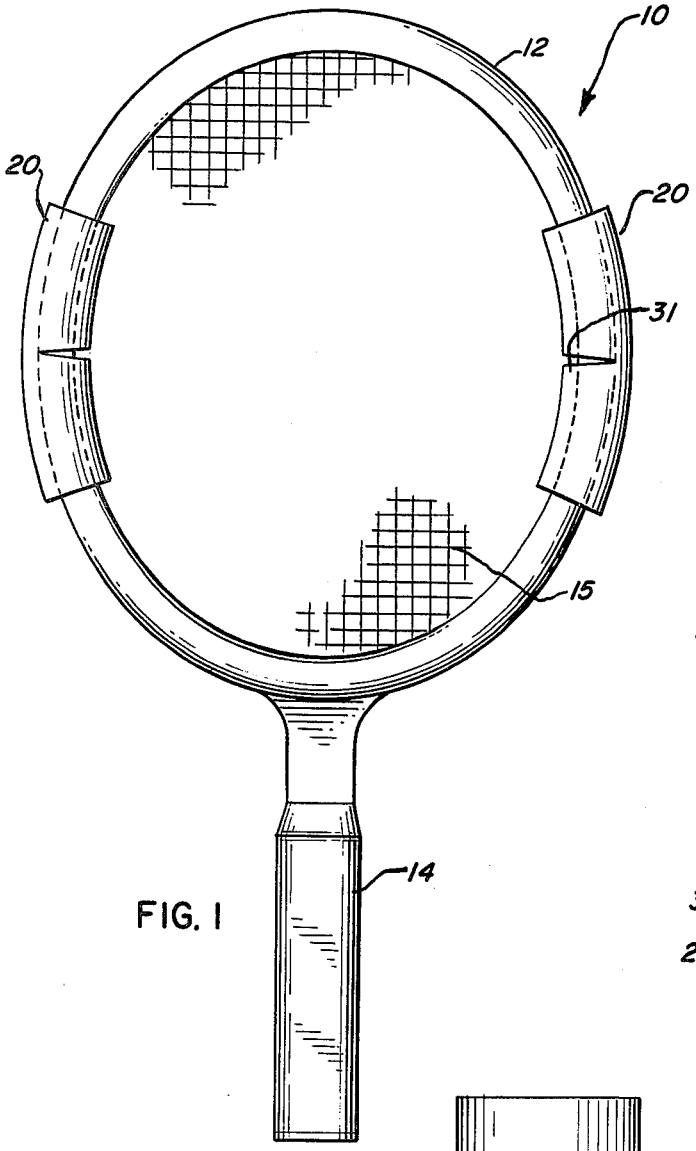
FIG. 1
FIG. 2
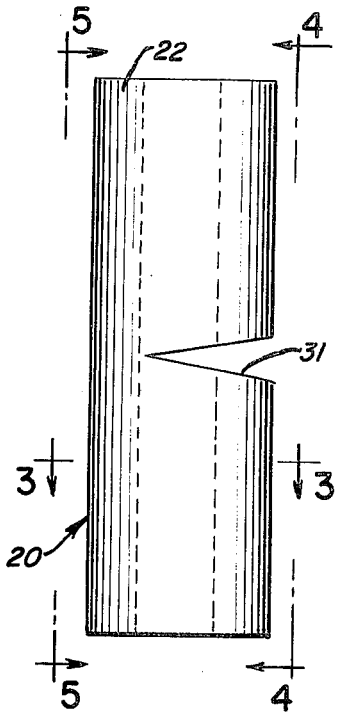
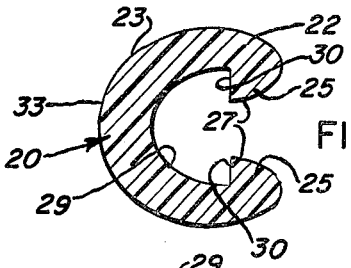
FIG. 3
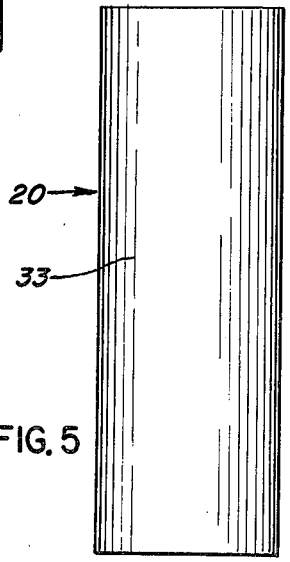
FIG. 5
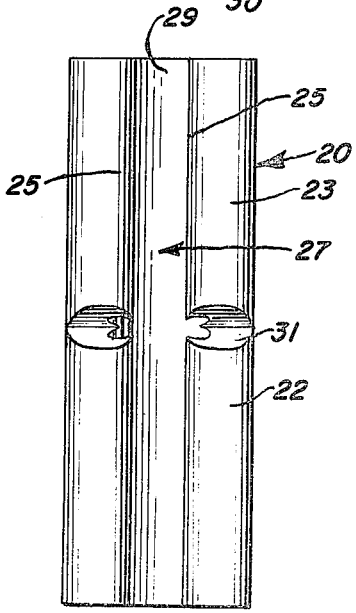
FIG. 4

RACQUET WEIGHT SYSTEM

BACKGROUND OF THE INVENTION

In recent years, there has been a tremendous increase in the number of indoor sports facilities in connection with the sports of both tennis and racquet ball. As a result, there has been a tremendous increase in a variety of accouterments and attachments incident to the playing of both of these games which are intended to aid the players in one form or another.

As has been known in connection with various other sports games such as golf, baseball and the like, it is deemed to be desirable to have exercising and training aids which permit the players to strengthen the appropriate muscles which are utilized in the playing of the game. In this connection, the use of weights intended for attachment to the appropriate sports equipment has been well known. For example, a variety of weighted attachments are provided for interconnection to a baseball bat to permit the player to swing a weighted bat prior to actually commencing the playing of the game. Exemplary of this type of device is shown in U.S. Pat. No. 3,971,559 which is directed to a circular weighted doughnut intended for insertion around the ball bat such that as the player continually swings the bat, the arm and shoulder muscles are exercised and toned in a manner which will improve the player's ability to swing the bat once the weight is removed. Similar devices are shown in connection with golf clubs as for example, U.S. Pat. No. 3,716,239, which shows a doughnut shaped weight attachment intended to attach to the base of the club immediately adjacent to the club head. Once again, the intent of the device is for use as a warm up weight to permit the player to familiarize himself with the swing of the club and also to exercise and tone the appropriate muscles such that when he uses the club without the weight, the club will feel lighter, the muscles will be better toned, and overall better swing is achieved.

Another form of a weighted device for a golf club is shown in U.S. Pat. No. 2,608,409 which again, is intended as a warm up device.

As indicated previously, with the tremendous increase in indoor tennis and racquetball facilities, there has been a desire on the part of the consuming public for similar types of devices intended for attachment to both tennis and racquetball equipment. However, the weighted devices intended for interconnection with the head rims of both tennis racquets and racquetball racquets have not been particularly convenient for the reason that often times, the intended weight devices require substantial change to the configuration of the racquet. One attempt has been made to develop a simplified tennis racquet weight and this is shown in U.S. Pat. No. 4,000,893. As shown therein, the weighted device is intended to be wrapped around a portion of the handle of the tennis racquet and basically includes a sheet of material incorporating Velcro-type fasteners as the locking means and further including weights formed of either steel balls or rods which are wrapped in the material lockingly engaged in the handle. Hence, while a device of this type does function to add weight to the racquet, it is believed that as a training and exercise device, it does not achieve the desired end since the weights are not located on the head of the racquet, but rather, are located on the handle portion.

A fairly recent attempt at developing a weighted system for the head rim of a tennis or racquetball racquet is shown in U.S. Pat. No. 3,907,292. As shown therein, the weight system consists of providing a plurality of weighted balls which are positioned internally within the head rim of the racquet, and held in position by a compressed spring. However, it is fairly obvious that to employ such a weighted system requires that the head rim of the racquet be cored appropriately and that the balls be inserted with the spring. Quite obviously, such a system is cumbersome, and more importantly, requires that the racquet construction be entirely different than the solid wood, metal or plastic racquets currently being manufactured. Hence, it is unlikely that a weighted system of this type would ever be commercially utilized.

Similarly, other types of weighting systems developed for tennis racquets or racquetball racquets have not achieved any degree of commercial success for the reason that they tend to be cumbersome devices and not quickly amenable to be used by the consumer. For example, U.S. Pat. No. 3,414,260 shows an adjustable weight exerciser for use on a tennis racquet which basically relates to a weight which is stretched across the rim portion of the racquet. Clearly, to utilize such a system, a strung racquet could not be employed since the stringing would definitely interfere with the positioning of the weight.

For the above reasons, it has been deemed desirable to develop a weight system for use on either tennis racquets or racquetball racquets which permits ease of installation and removal, while nevertheless performing a weighting function for purposes of exercise and training.

OBJECTS AND ADVANTAGES

It is therefore the principal object of the present invention to provide an improved weighting system for use in connection with the head rim of a tennis or racquetball racquet which permits ease of installation and removal while at the same time does not interfere with the strung surface of the racquet.

In connection with the foregoing object, it is another object of this invention to provide an improved weighting system for the head rim of a sports racquet of the type formed by a substantially circular head rim adapted to accommodate a strung surface and having a handle portion extending outwardly therefrom, the weight system being formed by weight means including at least one weight member formed by a weighted resilient material, the weight means having a substantially circular configuration along the exterior periphery thereof and terminating in an interrupted neck portion bounded by opposed legs, the weight means further including an interiorally cut-out mounting groove, the mounting groove corresponding with the external configuration of the substantially circular head rim of the racquet, the legs bounding the neck portion being sufficiently resilient to stretch laterally a distance sufficient to permit the weight means to be positionally mounted on the head rim with a portion of the head rim encased within the mounting groove of the weight means.

In connection with the foregoing object, it is a further object of the invention to provide a weight member of the type described which further includes a V-shaped cut-out positioned approximately mid-position along the member body portion thereby to accommodate the arcuate mounting of the weight means along the circular portion of the head rim.

Still a further object of the present invention is to provide a weight system of the type described above wherein the weight means consists of a pair of weighted resilient members, each of the members designed and constructed to encase a portion of the head rim at diametrically opposed locations along the periphery of the sports racquet head rim such that the sports racquet which includes the weighted resilient members mounted thereon is both weighted and balanced in order to permit the user the opportunity to swing a balanced racquet for training and exercise purposes.

In connection with all of the foregoing objects, it is yet a further object of the invention to provide a weight system for a sports racquet of the type described wherein each of the weight members has a weight of between 10 and 25 grams such that the overall weight of the weighted members when installed on the racquet is between 20 and 50 grams.

In connection with the foregoing object, it is yet a further object of the invention to provide a weight system of the type described wherein the pair of weighted members are positioned at diametrically opposed locations along the periphery of the racquet rim such that the weights will accomplish a balancing of the racquet in order to facilitate the exercise and training function of the weight system when employed on the racquet.

Still a further object of the invention is to provide a weight system of the type described, basically consisting of a pair of weight members wherein the arcuate or length dimension of each of the weight members is approximately 1/6th of the overall circumference of the racquet head.

Further features of the invention pertain to the particular arrangement of the parts and elements whereby the above outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

The following views are shown in the accompanying drawings:

FIG. 1 is a top plan view showing a representative racquetball racquet having a weighting system of the present invention positionally mounted in diametrically opposed positions along the rim of the racquet head;

FIG. 2 is a side elevational view showing one of the weighted members of the weight system and indicating the V-shaped cut-out portion thereby to accommodate the arcuate mounting thereof on the head of the racquet;

FIG. 3 is a cross sectional view taken in the direction of the arrows along the line 3—3 of FIG. 2 and shows the basic configuration of a weighted member in accordance with the present invention;

FIG. 4 is a side elevational view taken in the direction of the arrows along the line 4—4 of FIG. 2 and shows the interiorally cut-out mounting groove which functions to permit easy mounting of the weight member to the racquet head; and FIG. 5 is a side elevational view taken in the direction of the arrows along the line 5—5 of FIG. 2 and shows the outer side portion of the weighted member, being the side directly opposed to the view as shown in FIG. 4.

SUMMARY OF THE INVENTION

In summary, the present invention provides an improved weight system for use specifically in connection with either a tennis racquet or a racquetball racquet head rim which permits ease of installation of the weight system and ease of removal therefrom. The weight system basically consists of a pair of weighted members, the weighted members being formed of a dense resilient material, which simply snaps on to the head rim of the racquet due to the mounting groove formed integrally with each of the weight members and which assumes the same configuration as the head rim such that once mounted, the weight members will stay in position during the training and exercise period, however, it may be easily removed by simply expanding the resilient legs to unsnap the legs in order to permit the user to utilize the racquet during the playing of the game. The construction of the weight system of the present invention, therefore, permits the user to utilize the weight system without requiring that the racquet be reconstructed in any manner. Hence, the weight system of the present invention may be utilized in connection with all of the presently existing racquets.

DETAILED DESCRIPTION OF THE DRAWINGS

The details of the present invention are specifically shown in the accompanying drawings. As shown in FIG. 1, a racquetball racquet, generally denoted by the numeral 10 is illustrated. As is understood by those versed in the sport, a racquetball racquet includes a head rim 12 which is substantially circular or oblong in configuration, and has a handle portion 14 extending laterally outwardly from one end thereof. The interior confines of the head rim are provided with a strung surface 15 as is well known. In the view shown in FIG. 1, a pair of weighted members 20 are illustrated in position on the head rim 12 of the racquet 10.

As shown in FIGS. 2 through 5 of the drawings, the details of construction of the representative weight member 20 are illustrated. As shown therein, each weight member 20 is shown to be formed of a solid body portion 22. In the preferred embodiment of the invention, the body portion 22 of the weight member 20 is ideally formed of a dense rubber material or alternatively, a dense resin plastic which has, in addition to weight characteristics, also resilient characteristics. As specifically shown in FIG. 3, the exterior periphery 23 of the body portion 22 is shown to be substantially circular in configuration and terminates at a pair of opposed legs 25 which define a neck portion 27 therebetween. The neck portion 27 is in open communication with an interiorally cut-out mounting groove 29 which, as shown in FIG. 3 assumes basically the configuration of the head rim 12 of the racquet 10.

As is also shown in FIGS. 2 and 4 of the drawings, the body portion 22 of the weight member 20 also includes a V-shaped cut-out 31 which functions to accommodate the arcuate mounting of the weight member 20 along the circumference of the head rim 12. As shown in FIG. 1 of the drawings, the weight member 20 is intended to be mounted directly onto the head rim 12 and this obviously requires that the body portion 22 of the weight member 20 be movable in an arcuate path.

The V-shaped cut-out 31 therefore permits the body portion 22 to be bent arcuately incident to the mounting thereof on the head rim 12.

As shown in FIGS. 3 and 5 of the drawings, the reverse side of the weight member 20 presents a smooth outer surface 33, which is the side of the weight member 20 opposite the neck portion 27.

As is evident from FIG. 1 of the drawings, each of the weight members 20 may be easily mounted on the head rim 12 of the racquet 10 simply by moving the leg portions 25 in diametrically opposed directions from one another thereby to expand the opening of the neck portion 27. The weight member 20 is then slipped on to the head rim 12 such that a portion of the head rim 12 will snugly fit within the interiorally cut-out mounting groove 29. As indicated previously, the configuration of the mounting groove 29 is designed to accommodate the nestled mounting of the head rim 12 therein. As is further shown in FIG. 3, the mounting groove 29 is shown to include stop shoulders 30 which are designed to stop and rest against the interior surface of the head rim 12. In this manner, the weight member 20 may be lockingly engaged onto the head rim 12 and cannot become disengaged unless actually removed by the consumer. Hence, the stop shoulders 30 function as safety devices to insure that when the user or player is training with the racquet 10 having the weight members 20 positioned thereon, and swinging the racquet, the weight members 20 will not become disengaged and present a danger to other players in the immediate vicinity. On the other hand, it will similarly be appreciated that the user may easily remove the weight members 20 by simply stretching apart the leg portions 25 thereby enlarging the neck portion 27 in order to unsnap or remove each of the weight members 20 from the head rim 12. It will therefore be appreciated that the racquet 10 need not be reconstructed in any manner in order to accommodate the easy insertion and removal of the weight members 20 of the present invention.

In terms of materials, it has been found that typical racquetball racquets weigh between 270 grams and 380 grams. It has further been found that the ideal range for add-on weight systems for such racquets should be no greater than approximately 10% of the weight of the racquet. Hence, each of the weight members 20 is found to be ideal if the same are within a weight range of 10 to 25 grams. By providing a pair of weight members 20, the combined total weight of the two weight members 20 will be between 20 and 50 grams. It has further been found that it is ideal to provide a weight member 20 which has an overall length no greater than approximately 1/6th of the circumference of the corresponding head rim 12 of the racquet 10. Hence, where two of such weight members 20 are provided, the overall dimension which the weight members 20 will consumer is approximately ⅓ of the overall circumference of the head rim 12. It is believed that if the weight members 20 exceed the weight characteristics set forth above, or the length dimensional characteristics as described herein, the weight members 20 become cumbersome to handle, cumbersome on the racquet when installed, and will not funtion any more efficiently as training and exercise attachments for the racquet head.

Hence, given the weight requirements as set forth above, one skilled in the art will appreciate that a particular rubber or resin plastic material may be selected having a sufficient density in order to achieve that weight characteristic within the length dimensions indicated. As has been indicated above, dense rubber materials are presently available which will achieve the desired weight characteristics as set forth herein. It has also been found that polyvinyl resin plastics will similarly function when the same are selected with sufficient density in order to achieve the weight requirement. The advantage of providing either rubber or polyvinyl resin plastics is the fact that the same may be extruded simply and cut into the desired length in order to simplify the manufacturing process.

It will be appreciated, however, that the weighted members 20 of the present invention may be formed from any other material and weighted accordingly by means of sand or shot which maybe positioned within the body portion 22 thereof, assuming that the body portion is left hollow. However, it is believed that the methods of manufacture are more complicated or at least economically expensive, and hence, the preferred embodiment would be formed of either a dense rubber or a dense plastic resin material.

It will further be appreciated that the weight system of the present invention can be adapted for use either in connection with racquetball racquets or tennis racquets, the only requirement being the proper configuration of the interiorally cut-out mounting groove. As shown in FIG. 3 of the drawings, the mounting groove 29 is specifically adapted for the configuration of the head rim 12 of a racquetball racquet 10. It is known to those skilled in the sport industry that a tennis racquet has a slightly different head rim configuration, and it is intended to be within the scope of the present invention that the mounting groove 29 may be accordingly adapted in order to have the basic configuration of the head rim of a tennis racquet.

It will be appreciated from the above description that by virtue of the present invention, an improved and more efficient weighting system has been provided for use in connection with the head rims of racquet type sports equipment which permits for ease in installation and ease of removal. At the same time, once the weighting system of the present invention is properly installed, locking means are provided to insure that the weight system will stay in position during the use of the system as a training and exercise device. It will also be appreciated that incident to the manufacture of the weight system of the present invention, the weight members may be easily formed as extruded pieces thereby reducing the overall cost while providing an improved weight system. Finally, as explained hereinabove, due to the resilient characteristics of the material, the weight system may be easily installed and removed by the user without the need of any extraneous tools or devices, and further, without the need for entirely reconstructing the head rim portion of the racquet involved.

While there has been described what is at present considered to be the preferred embodiment of the invention, it will be understood that various modifications may be made therein and it is intended to cover in the appended claims all such modifications as fall within the true spirit and scope of the invention.

What is claimed is:

1. An improved sports racquet and weight system comprising in combination, a sports racquet of the type formed by a substantially circular head rim forming a boundary for said racquet;

said head rim having a strong surface carried within the boundary thereof;

said head rim further including a handle portion extending outwardly therefrom;

weight means including at least one weight member formed by a weighted resilient material;

said weight means being elongate along the longitudinal axis and having a substantially circular configuration along the exterior periphery thereof and terminating in an interrupted neck portion bounded by opposed legs;

said weight means further including an interiorally cutout mounting groove;

said mounting groove corresponding with the external configuration of the substantially circular head rim of said sports racquet;

the legs bounding said neck portion being sufficiently resilient to stretch laterally a distance sufficient to permit said weight means to be positionally mounted on said head rim of said racquet with a portion of said head rim encased within said mounting groove of said weight means;

said weighted member having an overall weight of between 10 and 25 grams;

said weight member having an overall arcuate length of approximately 1/6 of the overall circumference of said sports racquet head rim;

said weight member being adapted to be removably engageable from said head rim of said sports racquet;

whereby said weight means may be positionally mounted along a portion of said racquet circular head rim thereby to add weight to the racquet head rim and function as a training and exercise device for the user thereof.

2. An exercise and training device as set forth in claim 1, wherein said weight member further includes a V-shaped cut-out portion positioned approximately mid-position of said member thereby to accommodate the arcuate mounting of said weight means on the circular head rim of the sports racquet.

3. An exercise and training device as set forth in claim 1 above, wherein said weight means is constructed to encase only a portion of the racquet head rim along a limited arcuate portion thereof.

4. The exercise and training device as set forth in claim 3, wherein said weight means comprises a pair of weighted resilient members, each of said members being designed and constructed to encase a portion of the head rim at diametrically opposed locations along the periphery of the sports racquet head rim, whereby the sports racquet including the pair of weighted resilient members mounted thereon is both weighted and balanced in order to permit the user to swing a balanced racquet for training and exercise purposes.

5. The exercise and training device as set forth in claim 4, wherein each of said weighted resilient members is formed by a dense rubber material.

6. The exercise and training device as set forth in claim 4 above, wherein each of said weighted resilient members is formed by a dense resin plastic material.

7. The exercise and training device as set forth in claim 6 above, wherein said resin plastic material comprises a polyvinyl resin.

8. The exercise and training device as set forth in claim 4 above, wherein the combined weight of said pair of weighted members, when mounted on the sports racquet head rim, adds between 20 and 50 grams of weight to the racquet, each of said pair of weight members being mounted in diametrically opposite positioning points such that the racquet head rim is diametrically balanced.

* * * * *